US005215153A

United States Patent [19]

Younes

[11] Patent Number: 5,215,153

[45] Date of Patent: Jun. 1, 1993

[54] APPARATUS FOR USE IN DRIVING OR WITHDRAWING SUCH EARTH ENTERING ELEMENTS AS DRILLS AND CASINGS

[76] Inventor: Joseph F. Younes, 16 Spring St., Augusta, Me. 04330

[21] Appl. No.: 789,650

[22] Filed: Nov. 8, 1991

[51] Int. Cl.[5] ..... E21B 3/02

[52] U.S. Cl. ..... 175/162; 173/149

[58] Field of Search ..... 175/52, 85, 162

[56] References Cited

U.S. PATENT DOCUMENTS

| | | | |
|---|---|---|---|
| 3,516,183 | 6/1970 | Serota | 175/162 |
| 3,913,753 | 10/1975 | Swartz et al. | 175/52 |
| 3,980,143 | 9/1976 | Swartz et al. | 173/100 |
| 3,987,856 | 10/1976 | Carl et al. | 175/162 |
| 4,049,065 | 9/1977 | Walter | 175/52 |
| 4,258,796 | 3/1981 | Horning et al. | 175/52 |
| 4,312,412 | 1/1982 | Loftis | 175/52 |
| 4,455,116 | 6/1984 | Lindstedt et al. | 175/52 |
| 4,593,773 | 6/1986 | Skeie | 175/162 |
| 4,629,014 | 12/1986 | Swisher et al. | 175/162 |
| 4,703,811 | 11/1987 | Lam | 175/162 |
| 4,860,837 | 8/1989 | Robert | 175/162 |
| 5,033,554 | 7/1991 | Younes | 175/19 |

*Primary Examiner*—Ramon S. Britts
*Assistant Examiner*—Frank S. Tsay

[57] ABSTRACT

Apparatus for driving earth entering elements such as drills and casings which can be threaded together to form strings has a column to be erected in a wanted position. The column is provided with a unit moveable lengthwise thereof between upper and lower limits. The elements have two vertically spaced pairs of transversely aligned lugs with the lugs of the two pairs vertically aligned. The unit is provided with clamping jaws which positively grip the driving end of an element and prevent its turning relative to the jaws only if the element is in the driving axis of the unit in a predetermined position such that its lugs can be caught when the jaws are closed. A loader carries a plurality of elements which are held in sockets parallel to the driving axis and is moveable between an inoperative position and a position in which a selected element is positioned in the axis and which will then have its lugs appropriately positioned for locking engagement by the jaws. A holder is also disclosed for gripping the driving end of a driven element. The apparatus can be operated to withdraw an element and transfer it to the loader with its lugs correctly positioned.

19 Claims, 18 Drawing Sheets

APPARATUS FOR USE IN DRIVING OR WITHDRAWING SUCH EARTH ENTERING ELEMENTS AS DRILLS AND CASINGS

BACKGROUND OF THE INVENTION

It is a common practise to employ in driving such elements as drills, casings and the like, elements which are so constructed that before one element is driven completely into the ground, another element of the same type can be threaded to the exposed end thereof and then driven with other elements added in the same manner until a so-called string is established penetrating the earth to a wanted depth.

It is also a common requirement that such elements, particularly drills and their extensions be withdrawn from the ground with the members of a string disconnected therefrom when each is completely exposed.

THE PRESENT INVENTION

The present invention has for its objectives the provision of apparatus enabling such elements to be rotated as they are driven or withdrawn with strings thereof formed or disconnected on a more efficient and effective basis than has been possible prior to the present invention.

These objectives are attained with apparatus comprising three components. The first such component is an apparatus having a driving unit operable to hold an element positively against movement relative thereto and move it in either direction lengthwise of the axis along which it is to be driven or withdrawn and rotate the held element while it is being driven or withdrawn and also while it is being connected to or disconnected from another element. The withdrawal of casings is seldom required.

The second component is a holding assembly by which the exposed end of a driven element may be locked against turning when another element is being connected thereto or detached therefrom.

The third component is a loader rotatably holding a group of elements which may be of more than one type. The loader is connected to the apparatus with its elements parallel to the axis of an element the loader to be swung from an inoperative position into and out of an operative position in the axis in which a selected element is held or in which the withdrawn element is to be placed.

The apparatus is operable to reciprocate the driving unit through a working stroke lengthwise of the axis which is at least of a length such that the unit has a first transfer position in which the loader may be brought into its operative position, a second transfer position, lengthwise of the axis, in which the unit engages and grips the selected element and a third position in which that element is disengaged from the loader so that the loader can be returned to its inoperative position out of the path of the unit. The element thus transferred to the unit is then moved along the axis and is connected to a driven element held by the holding assembly or driven into the ground.

The driving unit by which elements are held and rotated, when and where their rotation is wanted, is in most cases not only operable to hold elements of different diameters, as is the case with a drill and its extensions and the casings which are to be driven into the bore established by the drill, but also to hold and drive an element of each type at the same time.

When an element, is to be withdrawn, its driving end is clamped to the unit. The unit is then moved in a pulling direction lengthwise of the axis until the element is pulled free or, if connected to another driven element, until the driving end of such other element is so exposed that it can be anchored by the holding assembly.

When such other element is thus anchored, the unit is operated to turn the wholly withdrawn element in an unthreading direction and, when freed, the unit is held in its first transfer position. With the loader so moved that a selected position therein for the removed element is in the axis, the unit is moved into its second position seating the element in the loader which is then released. After the unit has been pulled back to its first transfer position, the loader is returned to its inoperative position and the withdrawing operation continued.

An important objective of the invention is to insure that once an element is gripped by the clamping means of the driving unit, it is releaseably locked thereto. To that end, elements are provided that have adjacent their driving ends two pairs of diametrically opposed, vertically aligned lugs which become mechanically connected to the clamping means only if a predetermined relationship exists between the element and the clamping means.

In accordance with this aspect of the invention, the loader is provided with a rotatable holder for a group of elements which requires that each element, in order to be supported thereby must be in a position such that its lugs are in that predetermined relationship when transferred to the driving unit. Further, when the holding assembly is used, the lugs are positioned to enable an element to be gripped otherwise. In driving operations, accordingly, no manual positioning efforts are required other than the placing of the elements in the loader. In withdrawing an element, the initial requirement is that the element to be detached and returned to the loader must have its lugs appropriately positioned to be locked to the unit.

This aspect of the invention avoids the necessity of turning an element to bring its lugs into a position to be locked to the unit, so that the predetermined relationship between the lugs and the unit, once established is maintained throughout driving and withdrawing operations.

Other objectives of the invention and the manner in which they are attained will be apparent from the following specification describing a presently preferred embodiment and the appended claims.

BRIEF DESCRIPTION OF THE DRAWINGS

The accompanying drawings illustrate a presently preferred embodiment of the invention

THE PREFERRED EMBODIMENT

Figure 30:
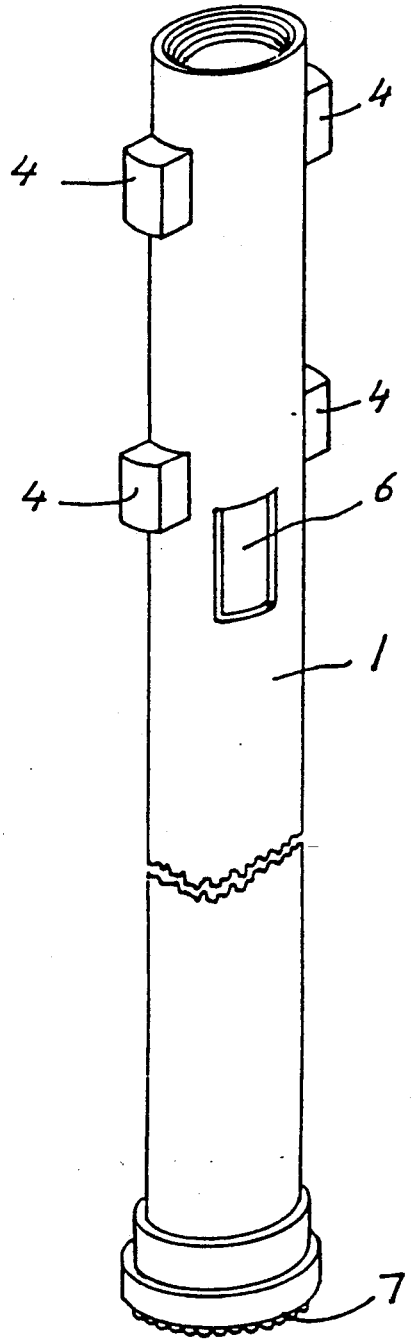
FIG. 30 is an elevational view of a drill in accordance with the invention.

The embodiment of the invention illustrated by the drawings is for use in driving or withdrawing such earth entering elements as drills, extensions thereof and casings. One such drill and extensions thereof, sometimes herein called drilling elements are generally indicated at 1 and 2, respectively. Casings are generally indicated at 3. A typical head drill 1 is shown by itself in FIG. 30.

Each of the elements, as is conventional, has its first or driving end internally threaded and, except for head drills, its second or driven end externally threaded to enable drill strings and casing strings to be formed by threading together the components of such strings or enabling such components to be disconnected one from another. Drill extensions 2 and casings 3 may both be seen in FIGS. 1, 4, 16, 18, 20, 21 and 24.

In accordance with the invention, the upper end of each drilling element and each casing is provided with two sets of diametrically disposed, short knobs or lugs 4 for drilling elements 1 and extensions 2 and 5 for casings 3, respectively, with the two sets spaced apart lengthwise of the element and with corresponding knobs or lugs of the pairs in alignment. In addition, each drilling element has diametrically opposed flat areas 6 see FIG. 30 which are parallel to the sides of the knobs or lugs 4. The term "drill" includes drills of the auger type, not shown, and drills having bits 7 see FIG. 30 the cross sectional dimensions of which establish the bore the casings 3 are to fit.

Before detailing the invention, it will be noted that it comprises apparatus, generally indicated at 10 see FIGS. 1, 3, 4, 18, 29, 31 and 32, for detachably holding and rotating an element and moving that element along a path which defines the axis of the element as it is being driven into or withdrawn from the ground G. The invention also provides, as a component of the apparatus, a holding assembly generally indicated at 11, see FIGS. 25 and 26, operable to hold a partly driven element by its flats thus to enable another element, placed in alignment and in contact therewith to be connected thereto, or, in the case of withdrawals, the apparatus to be operated to disconnect an element from the one held by the holding assembly.

The apparatus also includes a loader, generally indicated at 12 and shown in FIGS. 1, 3, 4, 6, 17, 18, 22 and 29, for a supply of elements which is operable in a manner and under conditions later detailed, to place an element in or remove an element from the above referred to axis of the apparatus. The loader 12 will subsequently be fully detailed.

The apparatus 10 is, as illustrated by the drawings, similar to that of U.S. Pat. No. 5,033,554 but altered, however, to enable it and the loader, generally indicated at 12, to function to effect the transfer of elements to or from the loader and to enable two different types of elements to be used by it. The apparatus also utilizes the holding assembly 13, which is operable to grip the still exposed driving end of a driven element shown as drilling element and hold it stationary while another element, held by the apparatus 10 in the axis thereof is lowered to bring its driven end into contact therewith.

Referring now to FIGS. 1, 2, 3 and 31, the apparatus 10 consists of a support column 30 upon which is mounted an element-clamping and rotating driving or withdrawing unit or carriage 32 adapted for movement along the column and the elements and the unit are both so constructed that endwise movement of a clamped element relative to the unit is positively prevented. The driving unit 32 is constructed to grasp the driving end of an element and impart a rotational force thereto, as described in more detail below, when element rotation is wanted.

Referring now also to FIGS. 1, 4, 29 and 31, the column 30 includes an outer casing 34. A pair of mounting members 36, 37 FIGS. 2, 3, 17 and 29 extend from the rear surface of the support column for attachment, see FIG. 31, of the apparatus 10 upon the tractor foreboom 20 and for attachment of the hydraulic cylinder 26.

Outriggers 38 and the associated hydraulic cylinders 40, see FIGS. 1, 3, 25 and 29, extend from attachment at the lower portion of the support column 30 to engage the ground surface G in a manner to orient and stabilize the apparatus 10 during operation. The support column 30 further includes an inner column member 42, see FIGS. 1 and 4, adapted for axial movement relative to the outer casing 34. The elements 43, 44, see FIGS. 2 and 17 and a top support plate 45, see FIGS. 1, 2, 18 and 29 and a bottom attached thereto. A vertical extension hydraulic cylinder 47 see FIGS. 2, 17 and 29, for axial adjustment of the position of the inner column member 42 relative to the outer casing 34 extends between the undersurface of the upper support plate 45 and attachment to the mounting members 36, 37 at the rear of the support column 30 by a pin 48 shown in FIG. 2. Adjustment of the axial position of the inner column member 42 permits adjustment of the length of the column upon which the driving unit 32 may travel between a greater length (FIG. 1), with the inner column member 42 extended for driving or withdrawal of an element as may be required by it or for lower clearance during movement of the apparatus by a tractor under bridges, power lines and other overhead obstructions.

Figure 1:
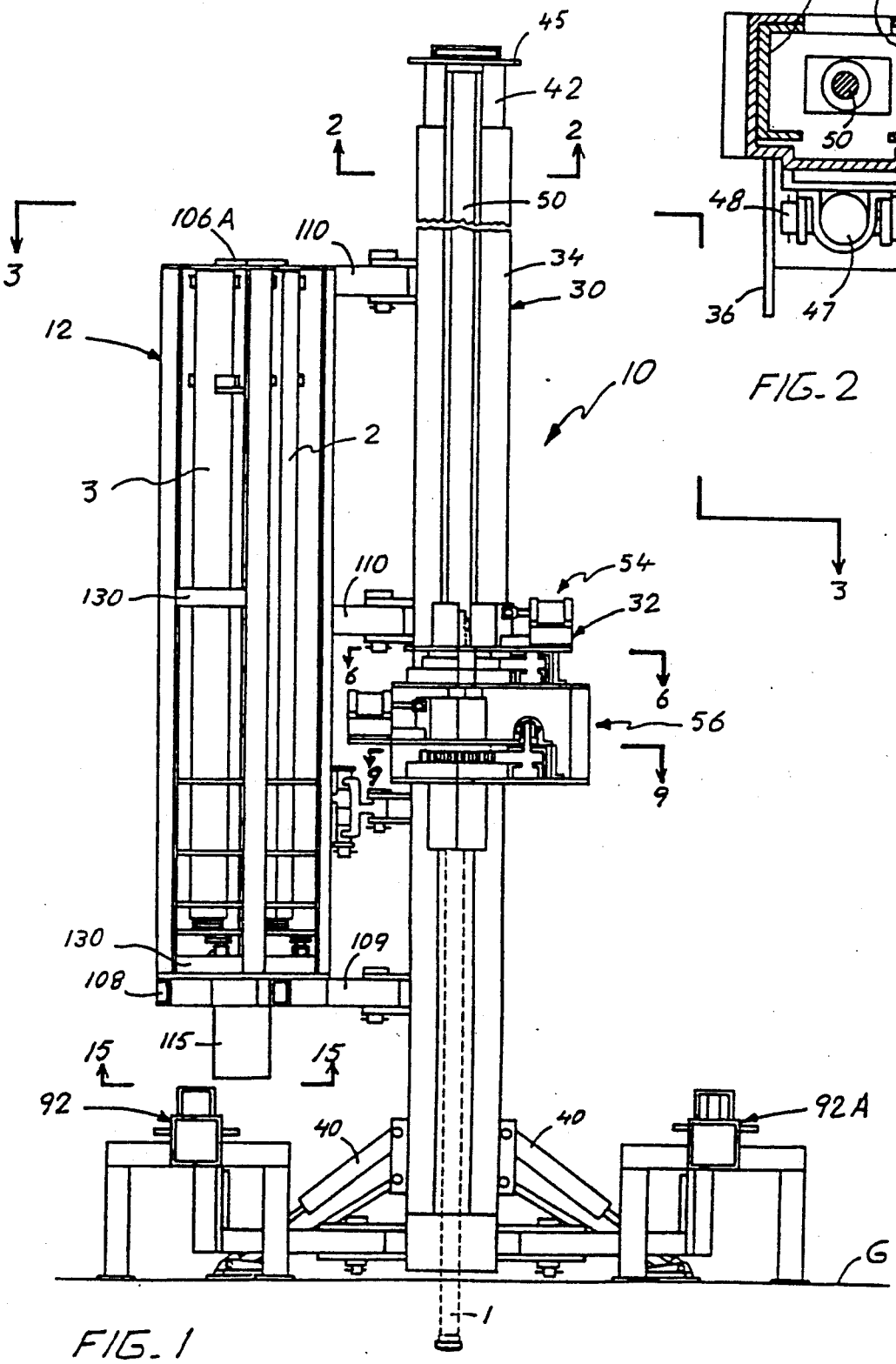
FIG. 1 is a front view of the apparatus with its holding assembly and loader set up for use with the lower clamping means of the driving unit closed the upper clamping means open thereof and the apparatus in use.
Figure 2:
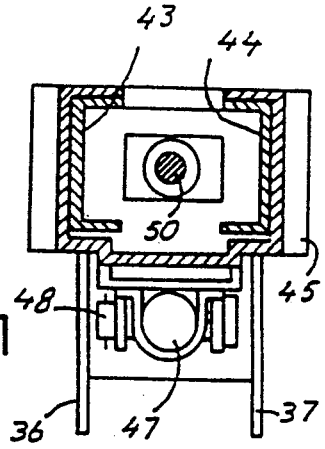
FIG. 2 is a section, on an increase in scale, taken along the indicated line 2—2 of FIG. 1.
Figure 31:
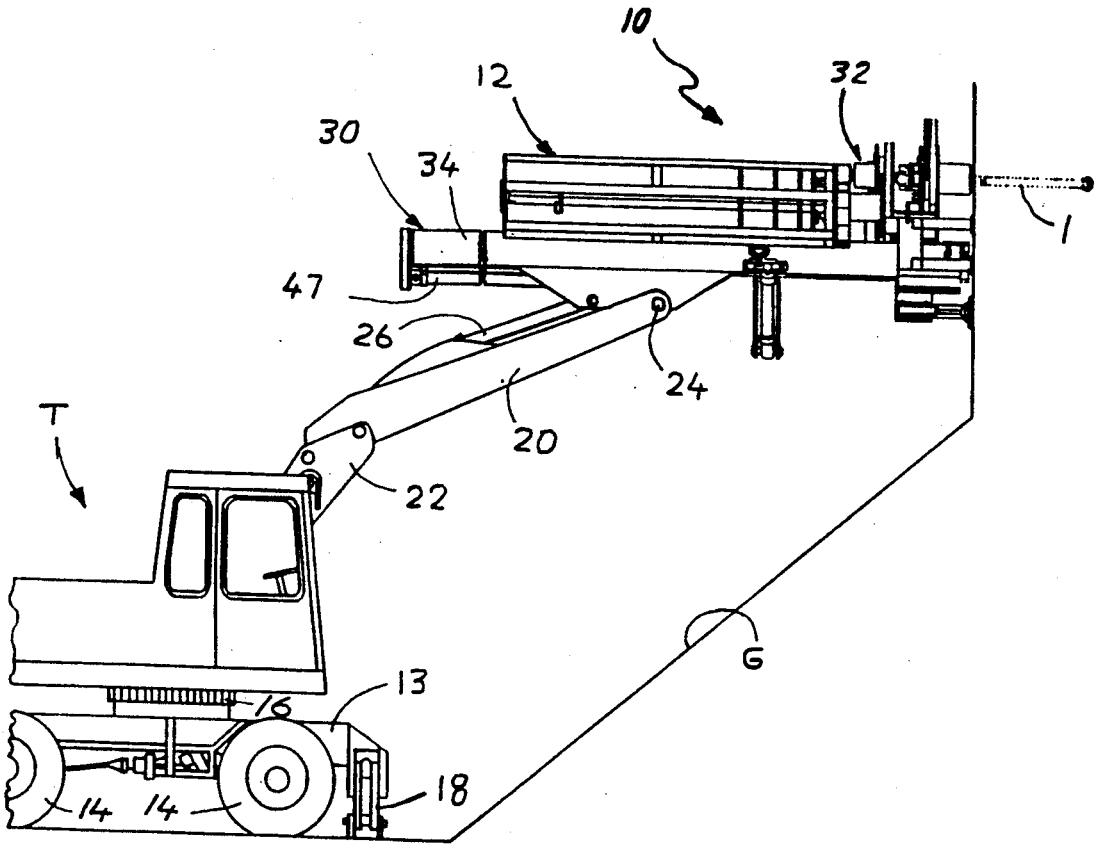
FIG. 31 is a view illustrating the apparatus, loader and holding assembly held by a tractor with the drill axis horizontal.
Figure 32:
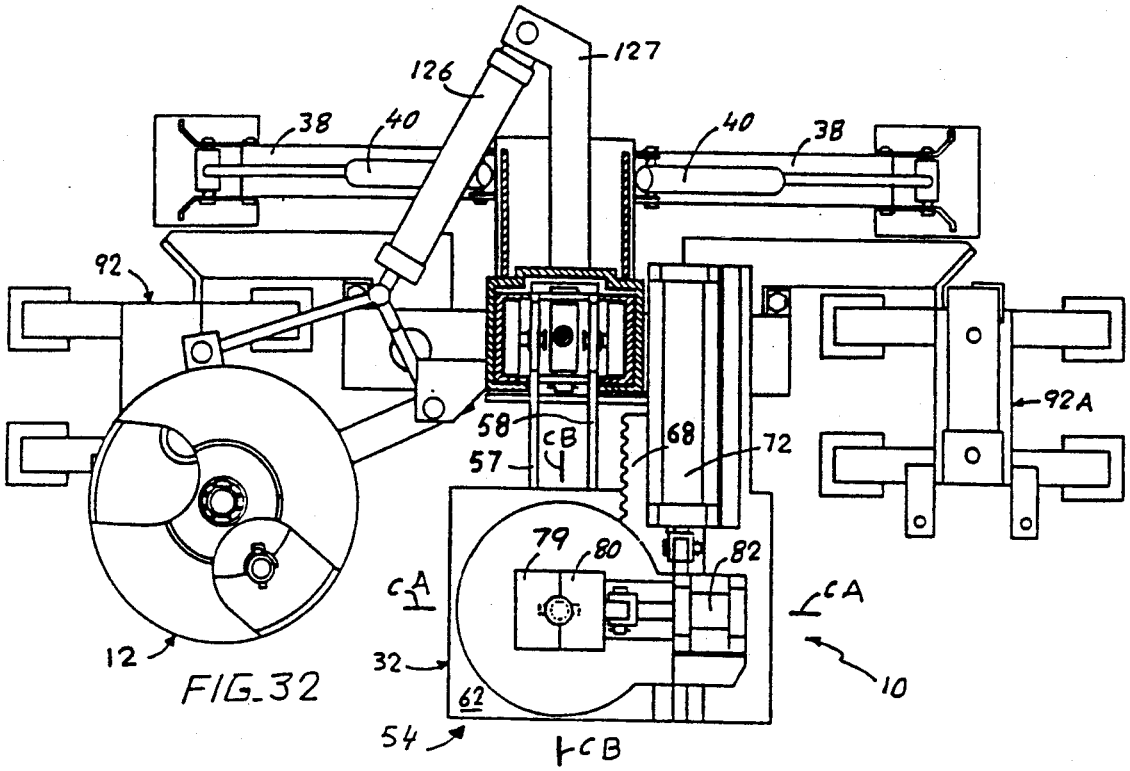
FIG. 32 is a section, similar to FIG. 3, illustrating a unit not using entrance slots.
Figure 33:
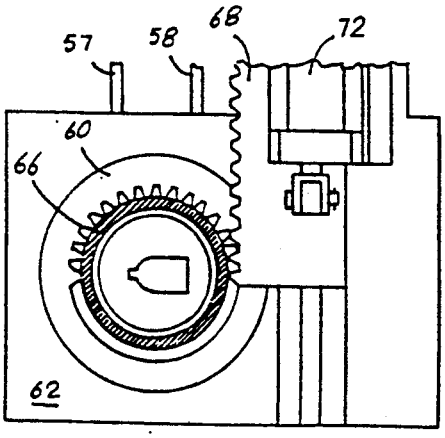
FIGS. 33 and 34 are views of the racks and associated gears of the upper and lower clamps, respectively, positioned at the start of a driving stroke.
Figure 34:
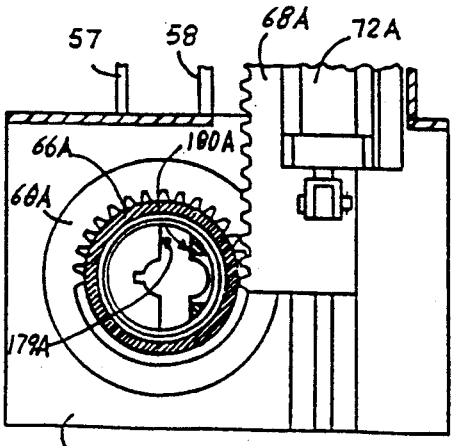

Referring now to FIGS. 1 and 2, hydraulic cylinder 50 is disposed vertically within the bore of the inner column member 42 and engages the unit 32 in a manner to raise or lower the unit relative to the support column 30 while applying force necessary for insertion or removal of an element into or out of the ground G following the orientation of the column 30 into a selected position of use relative to the ground illustrated by FIGS. 1 and 31. Hydraulic cylinder 50 is attached at its upper end to the upper support plate 45. At its lower end, cylinder 50 is attached to driving unit 32 by pin 51 which may be seen in FIGS. 3 and 17. The driving unit 32 is moved vertically along the support column 32, 30, as shown in FIG. 1 or horizontally as shown in FIG. 31 in response to actuation of the cylinder 50, riding upon bearings 52 within the inner column member 42, see FIGS. 3 and 17.

Figure 5:
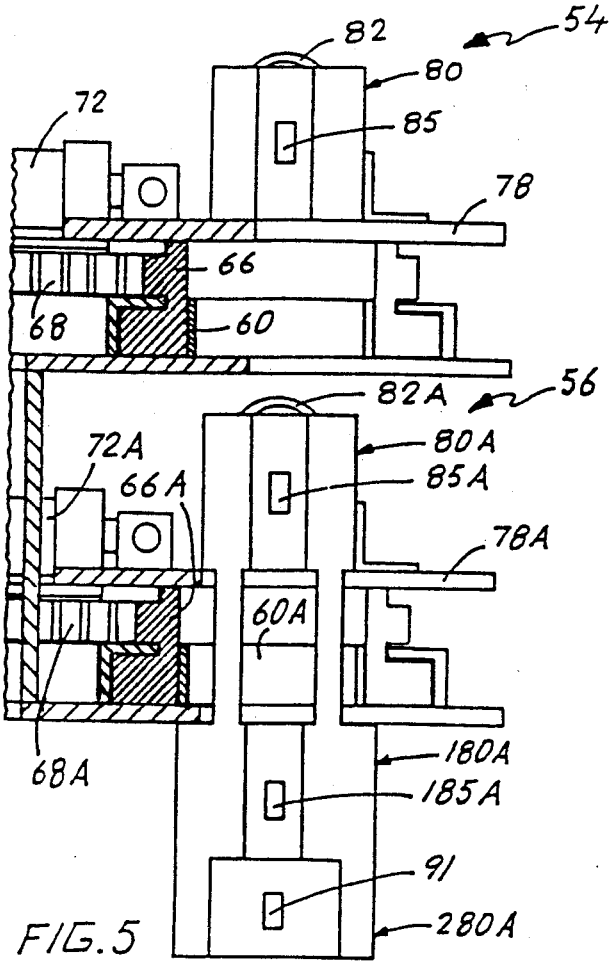
FIG. 5 is a partly sectioned view of the unit on a further increase in scale and taken along the indicated line 5—5 of FIG. 3.
Figure 6:
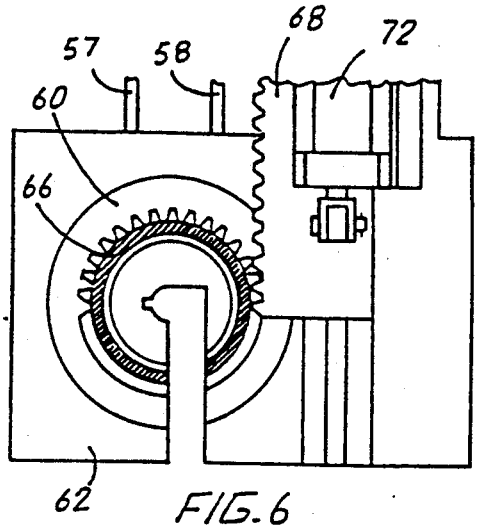
FIG. 6 is a section, on an increase in scale, taken approximately along the indicated line 6—6 of FIG. 1.
Figure 8:
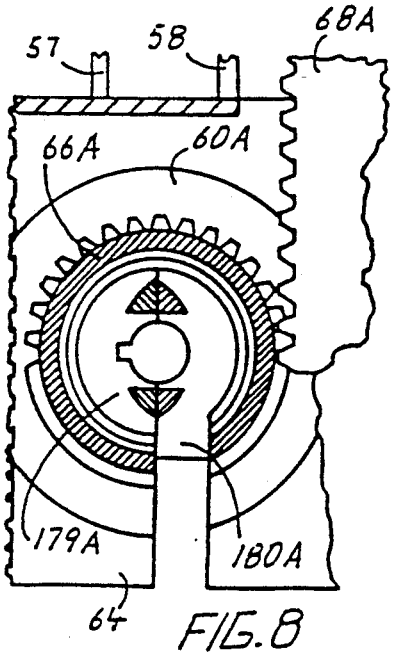
FIG. 8 is a view of the structure illustrated by FIG. 7 but with one of the clamping means closed.
Figure 7:
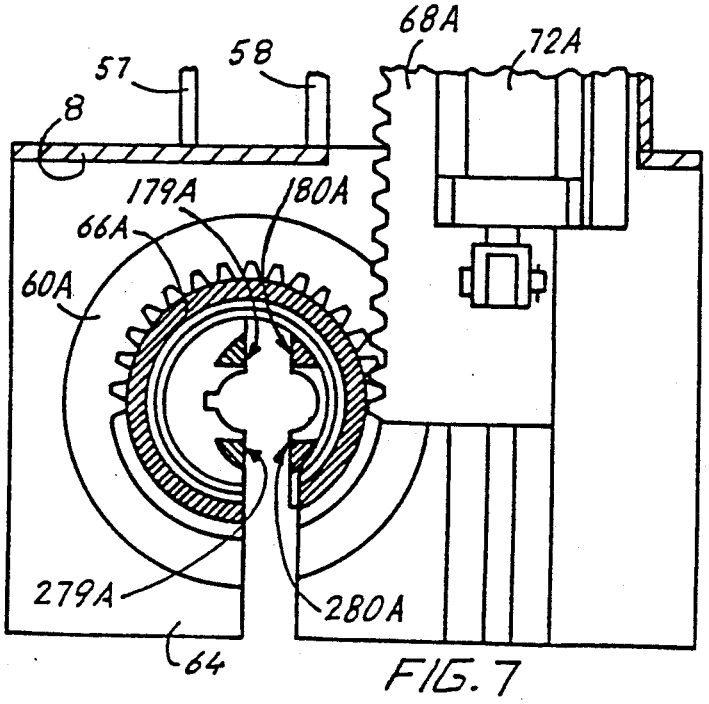
FIG. 7 is a section, also on an increase in scale, taken along the indicated line 7—7 of FIG. 1.
Figure 9:
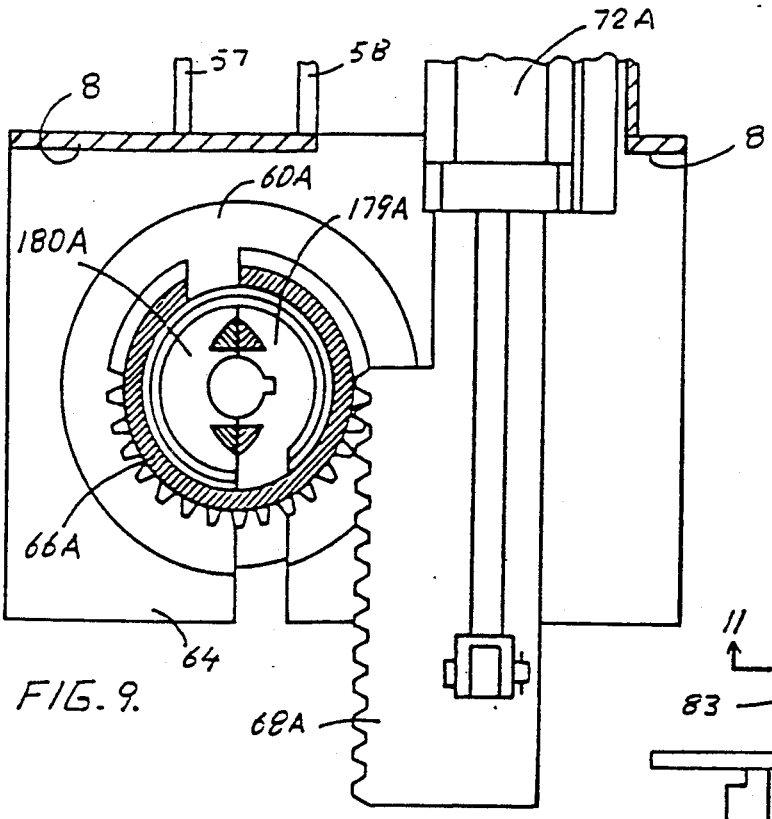
FIG. 9 is a section, on the scale of FIG. 8, taken approximately along the indicated line 9—9 of FIG. 4.
Figure 11:
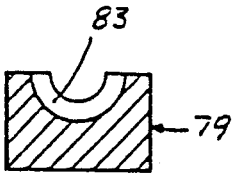
FIGS. 11, 12, 13 and 14 are sections taken along the indicated lines 11—11, 12—12, 13—13, 14—14 respectively of FIG. 10.
Figure 10:
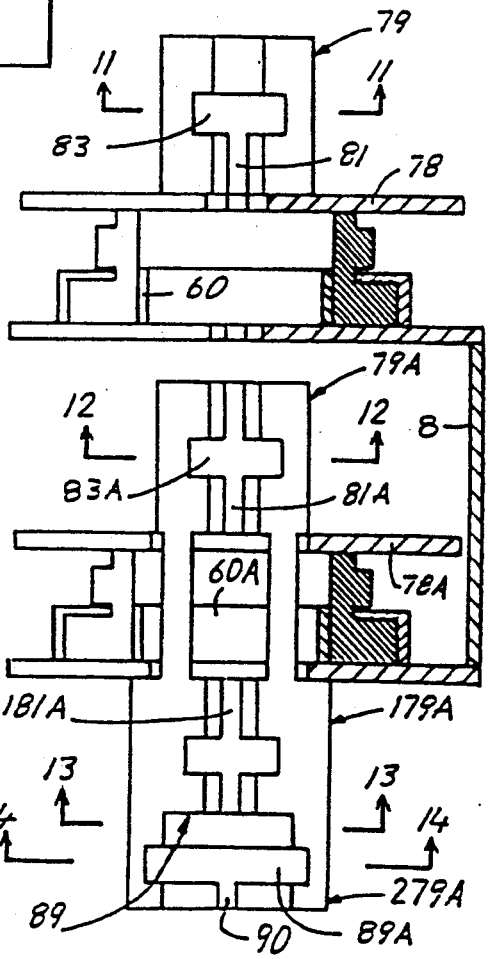
FIG. 10 is a partly sectioned view, on an increase in scale taken along the line 10—10 of FIG. 3.
Figure 12:
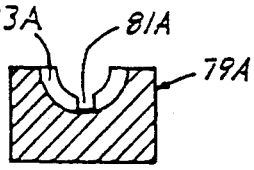
Figure 13:
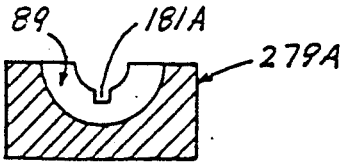
Figure 14:
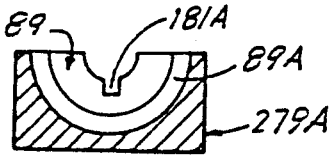
Figure 16:
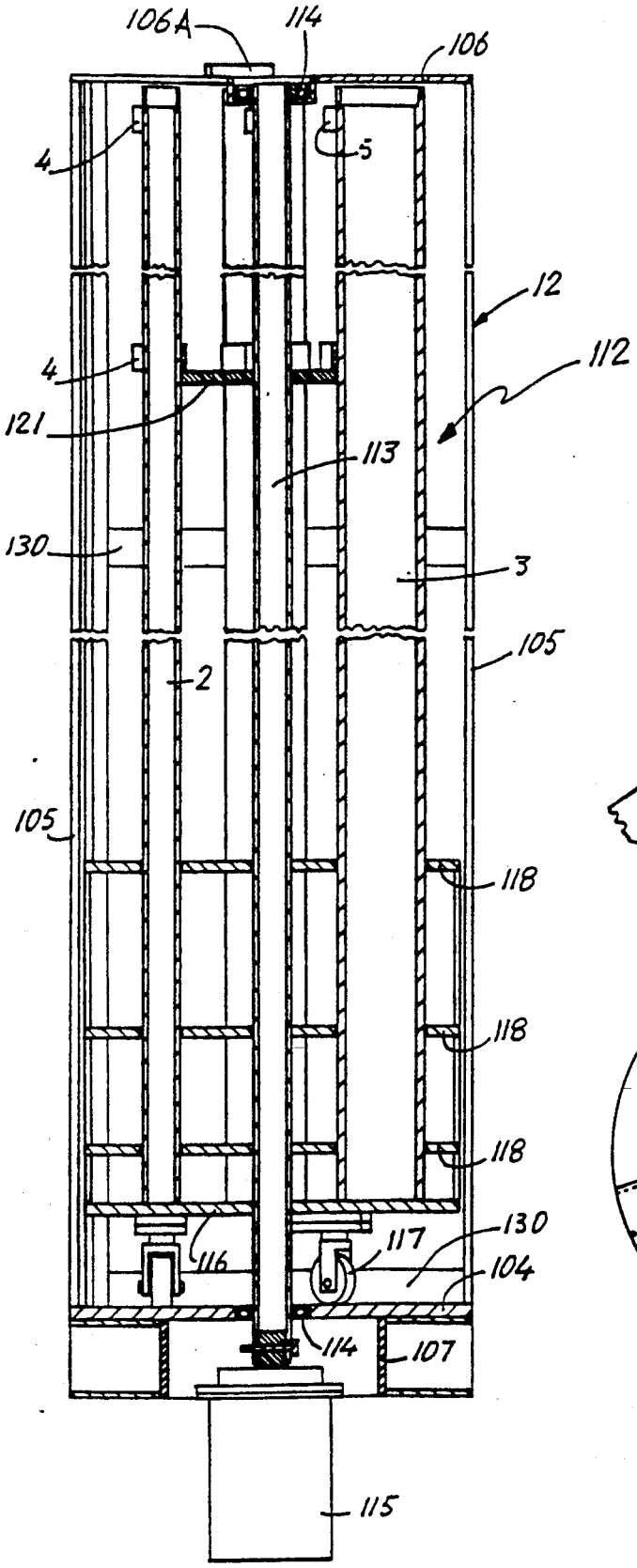
FIG. 16 is a section taken vertically through the loader, on an increase in scale and taken along the indicated line 16—16 of FIG. 3.
Figure 15:
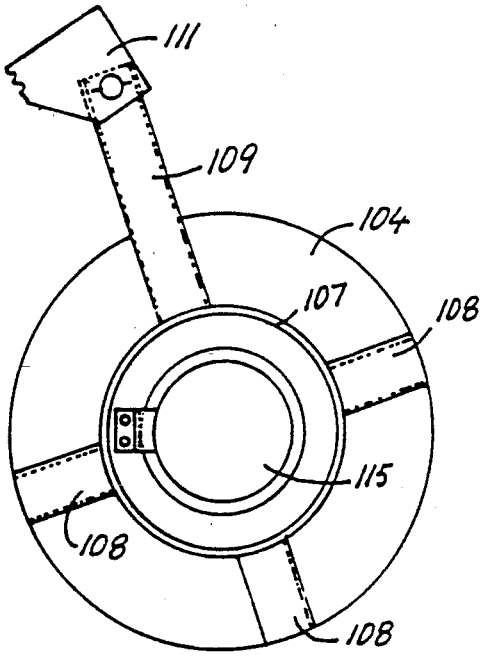
FIG. 15 is a view of the loader taken along the lines 15—15 of FIG. 1.
Figure 29:
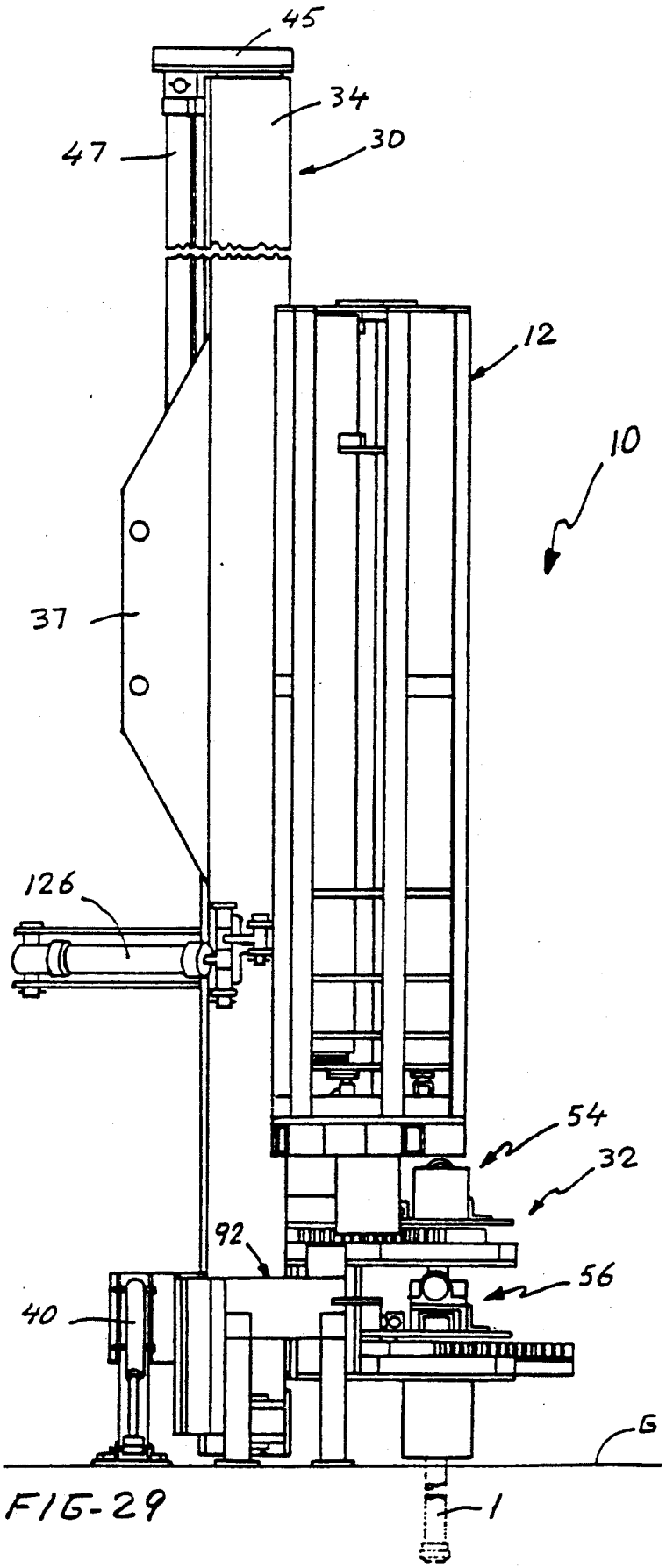
FIG. 29 is a side view of the apparatus with the driving unit in its lowest operating position.

The driving unit 32 includes an upper rotating clamp assembly 54 and a lower rotating clamp assembly 56 which are actuated asynchronously to apply torque to the element being driven or withdrawn. A supporting frame 33 for the unit 32 is formed by four vertically oriented steel plates 57, 58, 59 and 60 which are shown in FIGS. 3, 6, 7, 8, 9 and 17. Plates 57, 58 extend from within the support column where the bearings 52 are mounted thereupon. Spaced apart plates 59, 60, which are attached at right angles between plates 57, 58, accommodate pin 51 attaching the vertical hydraulic cylinder 50 to the unit 32. Rotatable clamp assemblies 54, 56 which are best seen in FIGS. 1, 5 and 29 are mounted upon horizontal support plates 62, 64 (FIGS. 22, 23 and 24), which in turn are mounted upon the outer arm extensions of plates 57, 58. Finally, the support frame further includes plates 8 vertical support plate disposed between horizontal support plates 62, 64 to reinforce the support frame 33.

When the vertical cylinder 50 is actuated for vertical movement within the support column 30, the horizontal support plates 62, 64 are raised and lowered along with the rotating clamp assemblies 54, 56 of the unit 32 mounted thereupon.

Referring now to FIGS. 3, 5, 10 and 22, the upper clamp assembly 54 and the lower clamp assembly 56 of the unit 32 are essentially the same in structure and function, except as subsequently noted, and, for ease of understanding, identical elements described with respect to the upper clamp assembly will be given the same reference number in the lower clamp assembly distinguished by the suffix addition "A". The rotating clamp assemblies 54, 56 are constructed to separately grip the upper and lower lugs 4 of a drilling element for application of rotational torque. Sleeves 60, 60A are mounted upon plates 62, 64, and rotatable gear members 66, 66A are mounted for rotation thereupon, see FIGS. 6, 7 and 22. Linear driving members 68, 68A are disposed upon the horizontal support plates 62, 64 and have teeth configured and arranged to mesh with the teeth of gear members 66, 66A. The driving members are actuated for oscillating motion by hydraulic cylinders 72, 72A which, as shown in FIGS. 3, 5, 6 and 7, are mounted between the driving members 66, 66A and the support plates 62, 64. The driving members 68, 68A include guiding portions 74, 74A which move axially within conduits defined by opposed pairs of angle members 76, 76A mounted upon plates 62, 64, see FIG. 22. By interengagement of the teeth of the driving members 68, 68A and the gear members 66, 66A, extension of hydraulic cylinders 72, 72A causes linear driving members 68, 68A to rotate gear members 66, 66A on sleeves 60, 60A to the positions shown in FIGS. 1 and 9. When the hydraulic cylinders 72, 72A are retracted in return strokes, the rotating clamp assemblies are returned to their original positions.

Clamp mounting plates 78, 78A are attached to the upper surfaces of the rotating gear members 66, 66A and support, opposed pairs of fixed and moveable jaw members 79, 80 and 79A, 80A, respectively, and their hydraulic cylinders 82, 82A. As shown, see FIGS. 3, 5 and 22 the mounting plates 78, 78A, the opposed jaws 79, 80 and 79A, 80A and the jaw actuation hydraulic cylinders 82, 82A are disposed to rotate with the rotating gears 66, 66A.

The jaw members 79, 79A and 80, 80A consist of rectangular blocks having inner surfaces of size and shape to receive and grip the driving end of a drilling element. Fixed jaw members 79, 79A are fixedly mounted upon plates 78, 78A, while the moveable jaw members 80, 80A are attached to guiding members 84, 84A received for axial sliding movement within the conduits defined by channel members 86, 86A. The hydraulic cylinders 82, 82A are attached to the guiding members 84, 84A by pins 87, 87A, and are mounted on supports 88, 88A mounted upon plates 78, 78A see FIGS. 3, 17 and 24. The hydraulic cylinders 82, 82A are actuated to move the jaw members 80, 80A towards fixed jaw members 79, 79A for gripping engagement of the lugs 4 of a drilling element therebetween.

An important feature of the present invention is that the jaws of both clamping means are so formed that when either the upper or the lower pair of jaws are in clamping contact with the driving end of a drilling element, a lug 4 thereof is held in a recess of the associated moveable jaw thereby establishing a positive connection between the element and the driving unit 32 in driving and withdrawing element.

Figure 22:
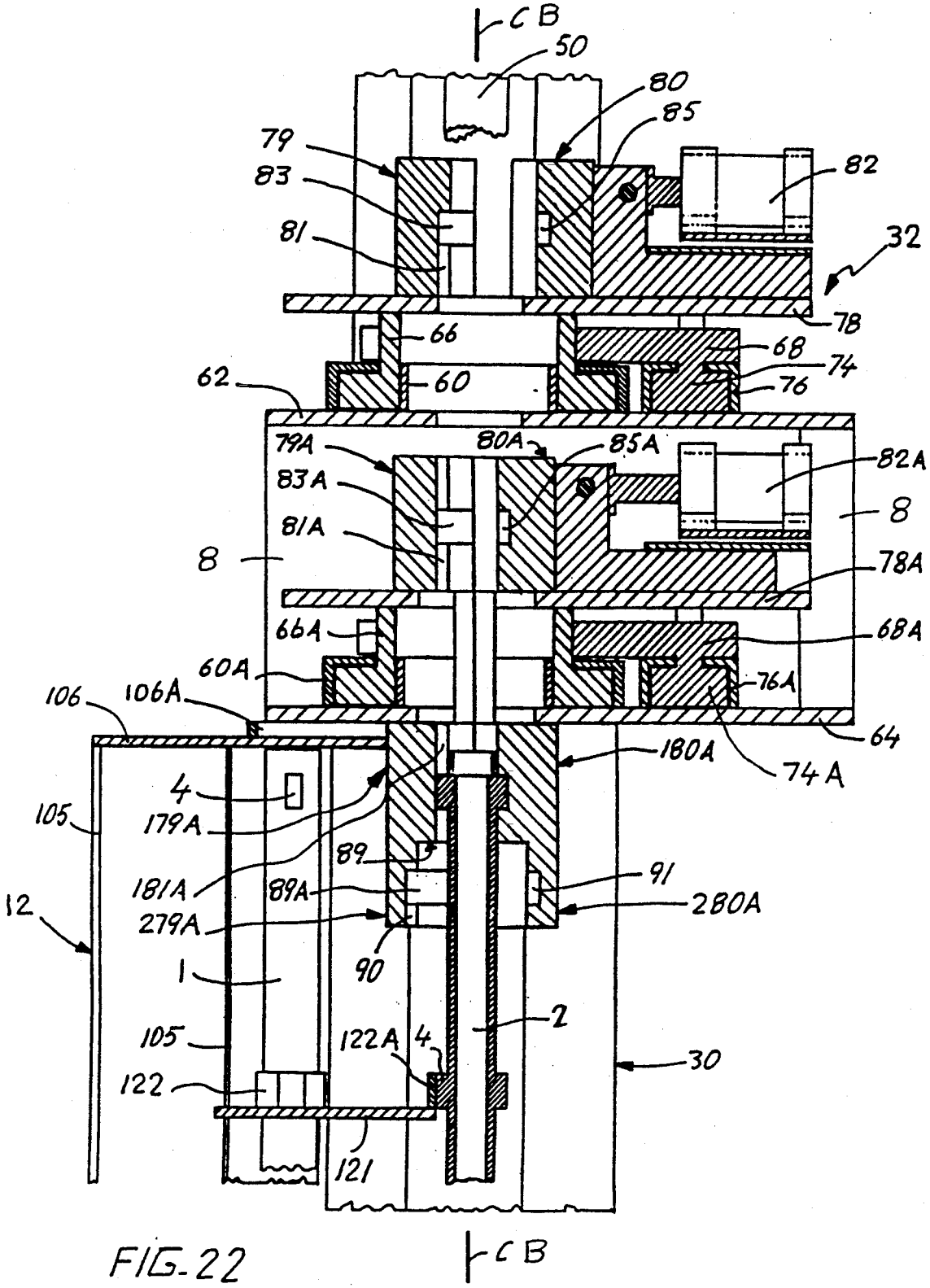
FIG. 22 is a fragmentary vertical section, on an increase in scale, showing the driving unit and the loader in their transfer positions.
Figure 23:
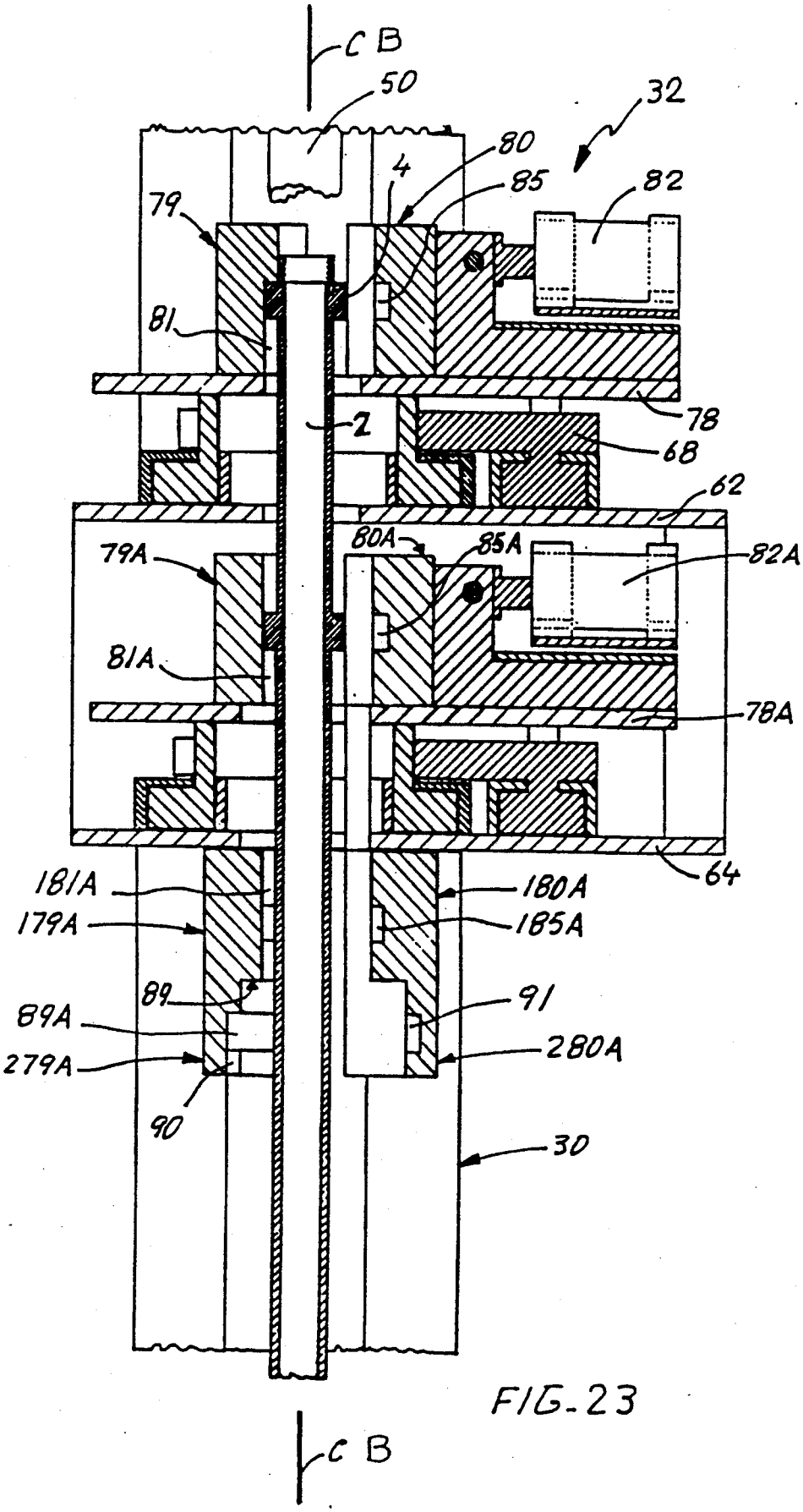
FIG. 23 is a corresponding section of the driving unit with an element, a drill or an extension thereof held free of the loader and seated against the ground or the driving end of a driven element to bring the element into position to be clamped and rotated thereby.
Figure 24:
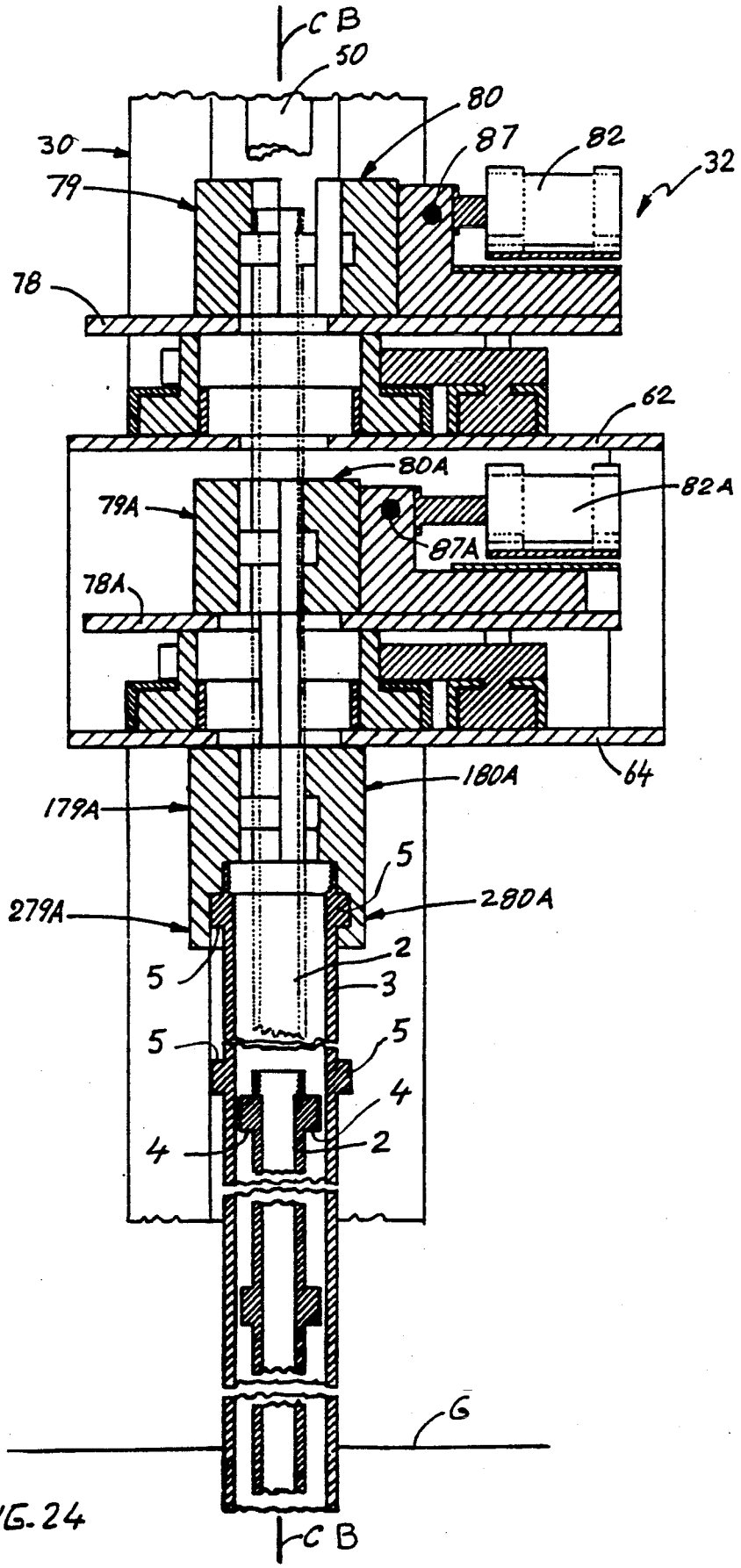
FIG. 24 is a like view but with the driving end of a casing shown in section held by the driving unit along with the drilling element of FIG. 23 which is shown in phantom.

To that end, see FIGS. 22–24, the fixed jaws 79, 79A have downwardly opening vertical channels 81 and 81A intersecting horizontal channels 83, 83A with the moveable jaws 80, 80A having recesses or pockets 85, 85A in transverse alignment with the channels 83, 83A and diametrically opposite the vertical channels 81, 81A. The vertical channels 81, 81A differ in that the vertical channel 83A also opens upwardly to enable a lug 4 to slide therethrough while the closed end of the channel 81 serves as a stop for that lug and positions the opposite lug and the other lugs for positive engagement by the moveable jaws. The channels 83, 83A permit the turning of the element when the associated moveable jaw of either of them is retracted.

Another important feature of the present invention is in the construction and use of the lower clamp assembly 56 and its fixed and moveable jaws 79A and 80A, see FIGS. 5, 10–14, 22 and 24.

The jaws 79A and 80A have integral portions extending below the driving unit 32 and have vertically spaced and integral pairs of jaws, the upper pair comprising the fixed jaw 179A and the moveable jaw 180A. The lower pair comprises the fixed jaw 279A and the moveable jaw 280A.

The upper jaws 179A and 180A are shown as identical to the jaws 79A and 80A and corresponding parts are not again detailed and the same reference numerals are employed for their designation but are distinguished by the prefix "1". The jaws 179A and 180A are employed in the withdrawal of a head drill, drill extensions 1 or 2 a casing 3 from the loader 12 or in the return to the loader of an element 1 or 2 withdrawn from the ground. The pocket of the moveable jaw 180A is indicated at 185A.

The lower jaws 279A and 280A are for use in gripping a casing 3 by its driving end and lugs 5 in taking it from the loader 12. The jaws 279A and 280A differ from the other jaws in that the fixed jaw 279A has a seat 89 shaped and dimensioned to fit against and over the threaded driving end of a casing 3 and, below it, a horizontal arcuate channel 89A of a greater radius to accommodate one of the lugs 5 of the casing 3, see FIG. 24. A vertical, open ended channel 90 intersects the channel 89A. The moveable jaw 280A has a recess or socket 91. The channels and the recess 91 are shaped and dimensioned to accommodate the lugs 5. The lower jaws 279A and 280A are for use in withdrawing a casing 3 from the loader 12 or when a casing is to be driven.

It will be appreciated that whenever an element is to have its threaded driven end connected to or disconnected from the upper end of a previously driven element, such connections and disconnections are best effected by holding the exposed end of such a driven element the function of the holding assembly 11.

The holding assembly 11 consists of two like table sections 92 and 92A shown in FIGS. 1, 3, 25 and 26 supported by spaced pairs of legs 93 and an end member 94. Each end member 94 is fixed on one end of an L-shaped arm 95 with the other ends thereof pivotally connected as at 96 to the base of the column 30 on opposite sides thereof.

Figure 3:
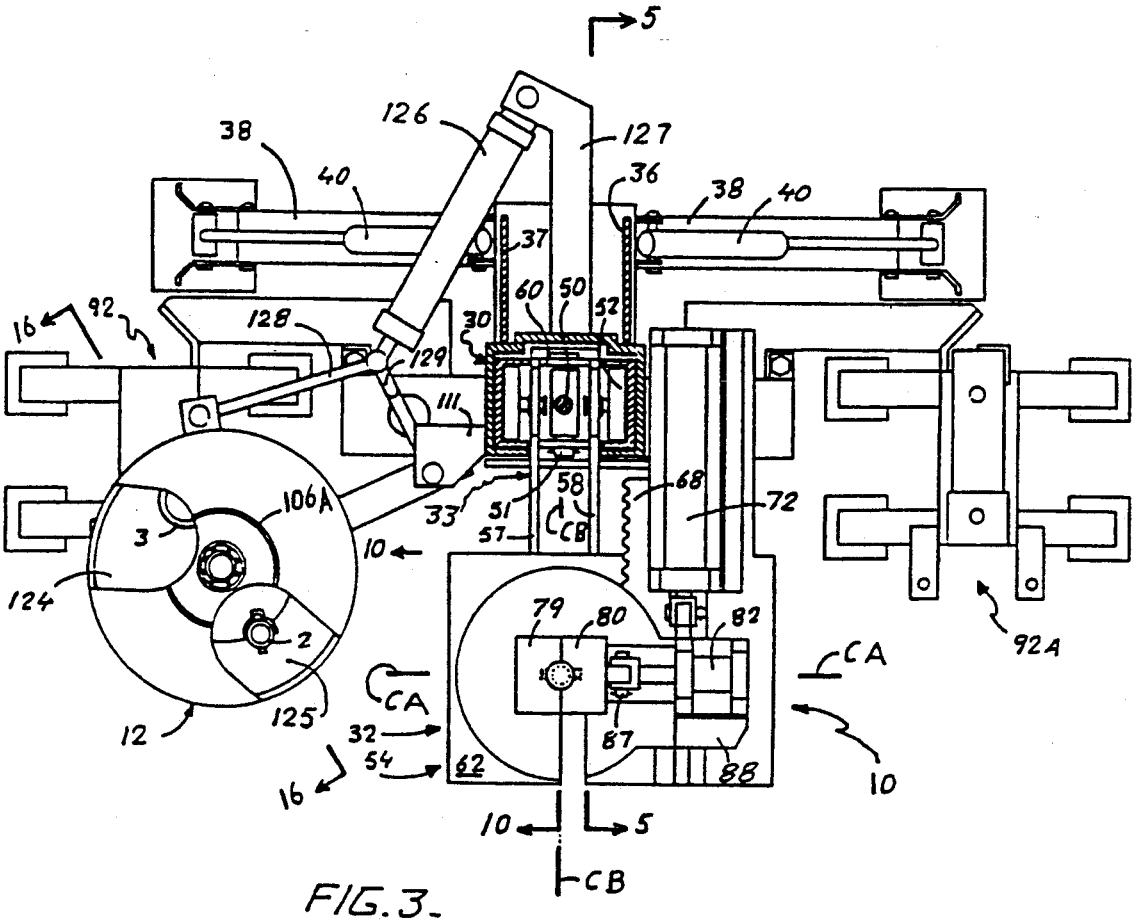
FIG. 3 is a section, also on an increase in scale, taken along the indicated line 3—3 of FIG. 1.
Figure 4:
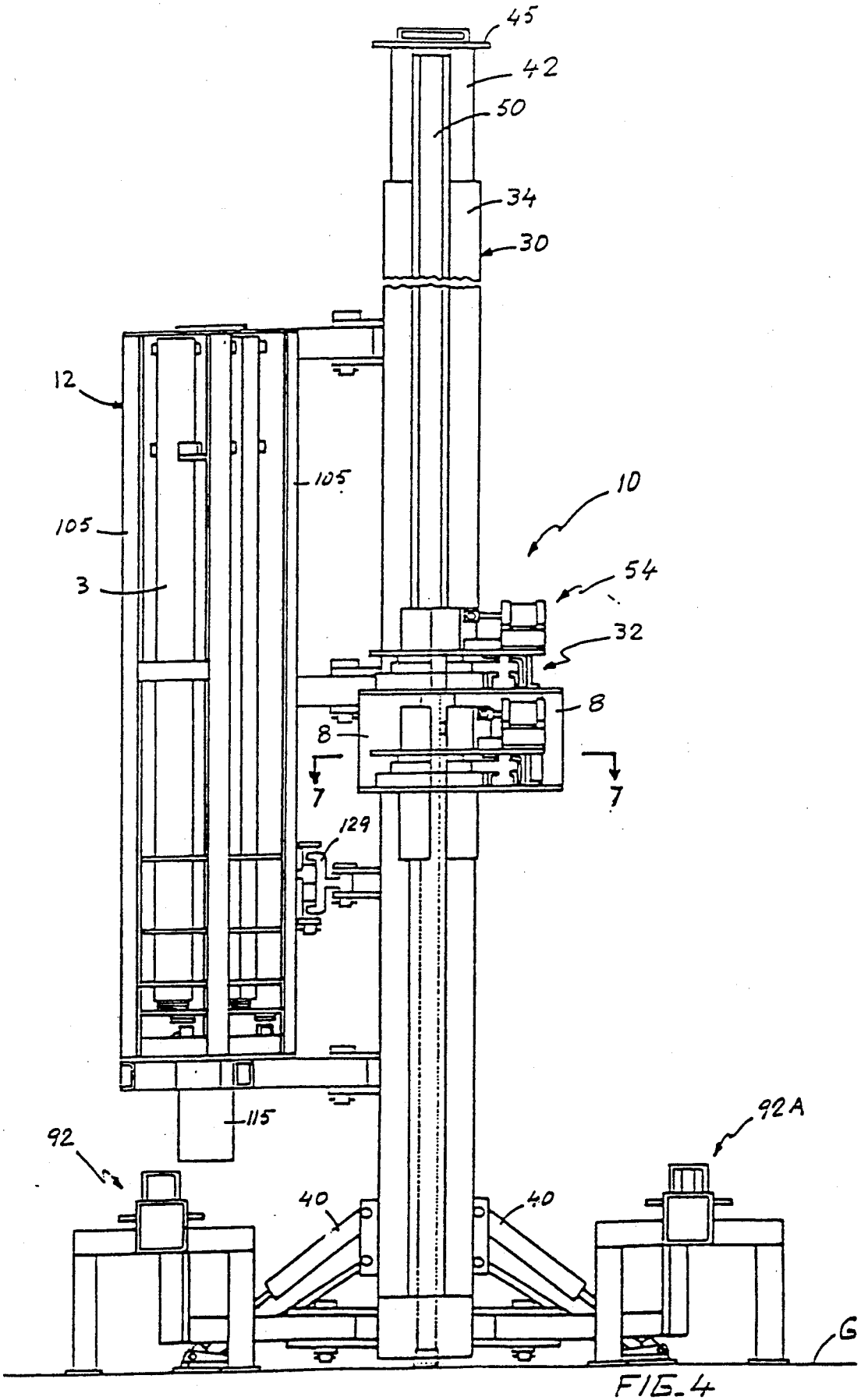
FIG. 4 is a view, similar to FIG. 1 but with the upper clamping means closed and the lower clamping means open.
Figure 25:
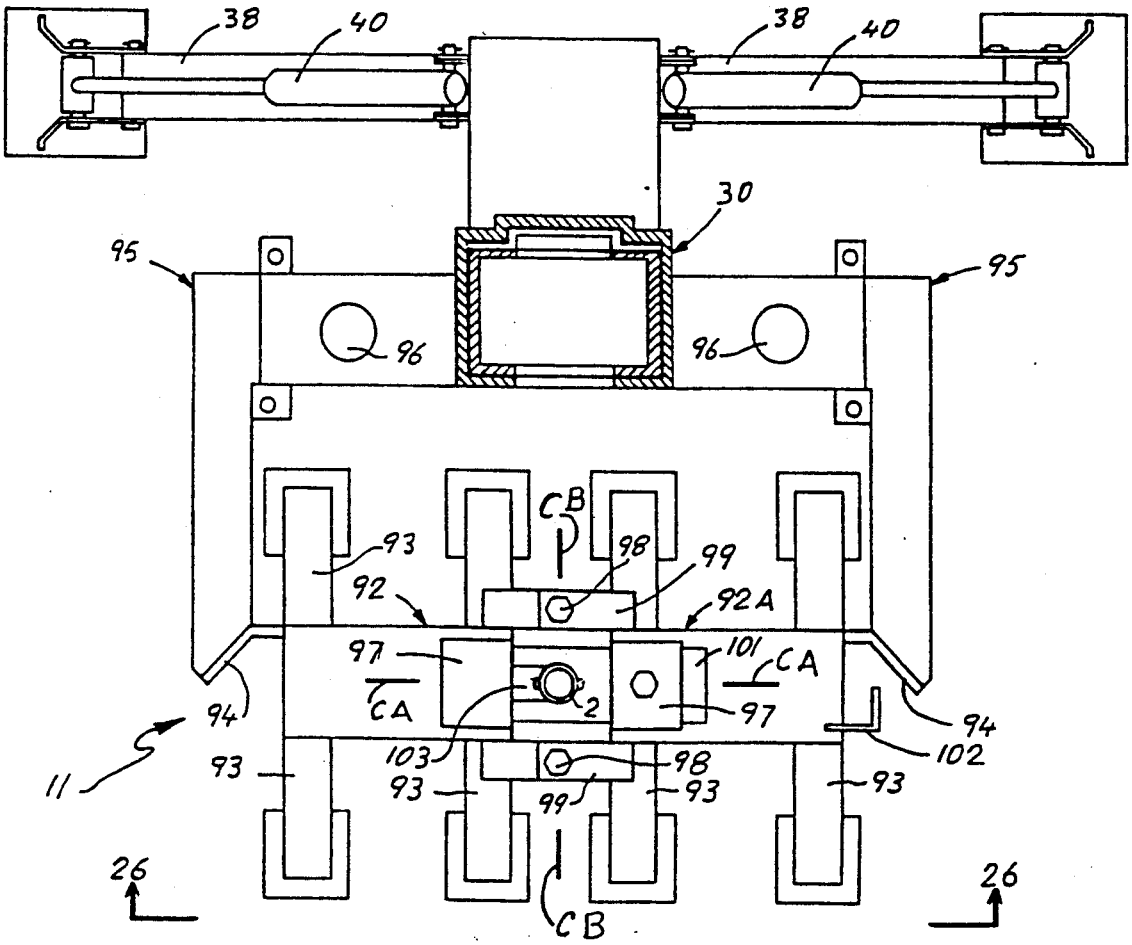
FIG. 25 is a plan view of the holding assembly with the column shown in cross section.
Figure 26:
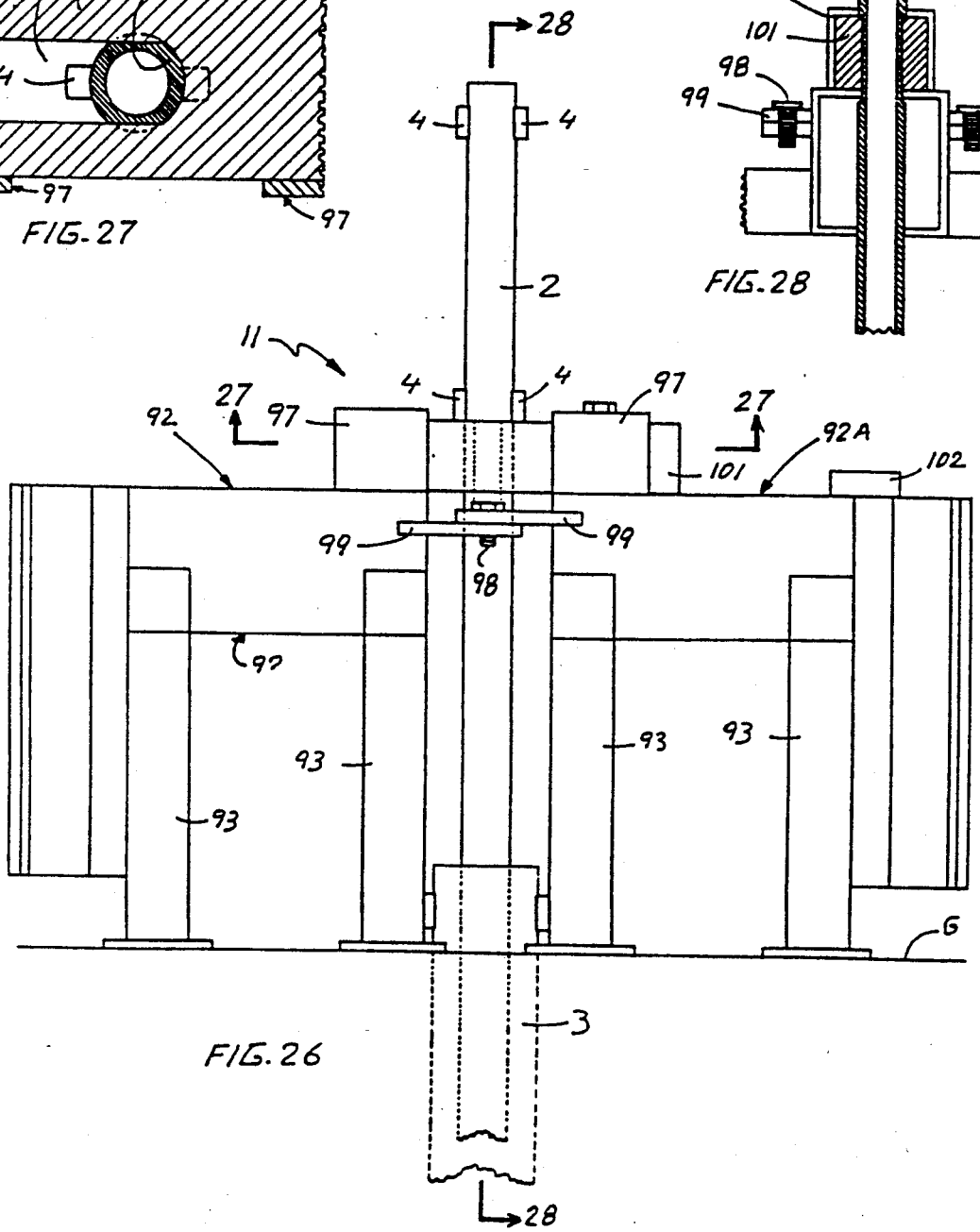
FIG. 26 is a view of the holding assembly as viewed along lines 26—26 of FIG. 25.

When the table sections 92 and 92A are swung from their inoperative position, see FIGS. 1 and 3, into their operative positions, see FIGS. 25 and 26, they are aligned but with their free end spaced apart to accommodate a casing 3 between them. The legs 93 support the table sections a distance such that the plane of the table exposes the flats of the driven drilling elements which are shown as parallel to the sides of the table sections. The drilling element of FIG. 26 has been withdrawn to that position.

Each table section 92, 92A has a slideway 97 with the slideways aligned when the holding assembly is set up for use, the two sections are connected by bolts 98 extending through connectors 99 fixed on the sides of the table sections 92, 92A see FIGS. 25 and 26.

One slideway 97 houses one end portion of a slide 101 with its other end portion butted against a stop 102. The slide 101 is of sufficient length to span the gap between the table sections with end portions slidably confined by both slideways 97.

Figure 27:
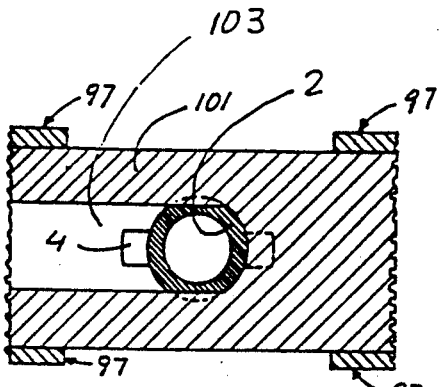
FIG.27 is a section taken along the indicated line 27—27 of FIG. 26.
Figure 28:
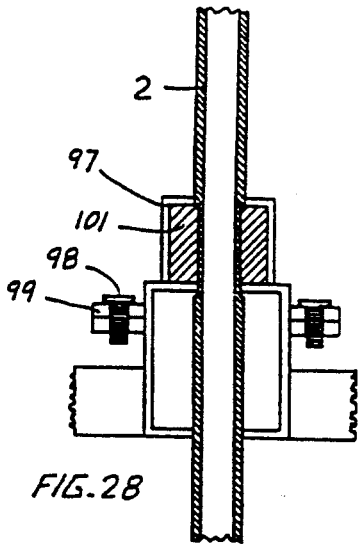
FIG. 28 is a section taken along the indicated line 28—28 of FIG. 26.

The end of the slide 101 initially confined by one slideway 97 and now confined in the other slideway 97, has a central slot 103 opening through the above referred to end and it is centered in alignment with the axis along which the elements are withdrawn. The slot 103 is of a length such that when held by both slideways 97, it and is of a width to slidably engage the flats 6 of the driven drilling element which as shown in FIG. 27 is thus held against turning when another drilling element is to have its driven end threaded on the driving end of the securely held driven element when rotated in one direction by the driving unit 32 or released therefrom if rotated in the other direction by the driving unit. It will be appreciated that the holding assembly is so positioned that the slot 103 is in vertical alignment with the path of the lugs 4.

The loader 12, see FIGS. 3, 4, 15–22, is generally cylindrical and has a circular base plate 104 connected by a series of arcuately spaced uprights 105 and vertically and horizontally spaced reenforcements 130 to a circular top plate 106. The base plate 104 is mounted on a supporting frame shown as consisting of an annular wall 107 and radial supports 108 and 109. The support 109 and vertically spaced arms 110, in vertical alignment therewith, are of lengths enabling them to be pivotally connected to the appropriate ones of the corresponding spaced mounts 111 fixed on one side of the column 30 and support the loader 12 above the holding assembly 11 in any position of either of them.

An internal rotary element holder, generally indicated at 112 consists of an axial post 113 rotatably held by bearing assemblies 114 mounted in the base and top plates 104 and 106. The lower end of the post 113 is connected through the base plate 104 to the drive shaft of a motor, an air motor 115, for example. The post 113 has a bottom plate 116 to the undersurface of which are secured casters 117 riding on the base plate 104. The lower part of the post 113 is provided with a series of vertically spaced plates 118 having vertically aligned holes 119 and 120 which establish sockets to receive and support, respectively, the lower end portions of the drilling elements and casings and hold the elements parallel to the driving axis.

The post 113 is also provided with a brace plate 121 located to be engaged by one of the lugs of the lower pair of the drilling elements and casings when seated in the appropriate sockets. As may best be seen with reference to FIGS. 19 and 21, the brace plate 121 has arcuate seats, the seats 122 for the head drills, and their extensions 2 and provided with a central vertical channel 122 such for one of the lower pair of lugs 4 of a drilling elements and seats 123 provided with a central vertical channel 123A for one of the lugs 5 of the lower pair of a casing 3.

Figure 17:
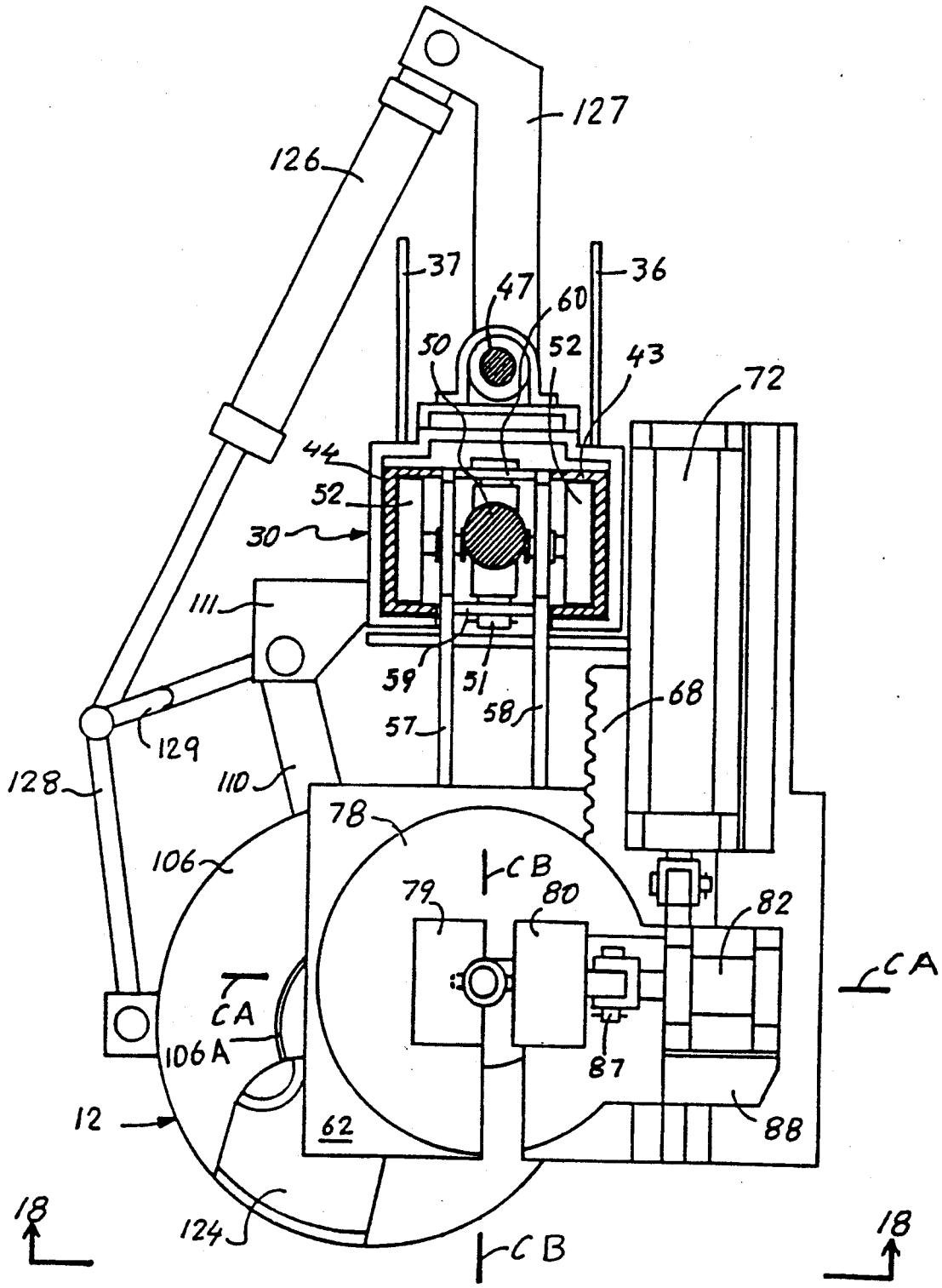
FIG. 17 is a partly sectioned view showing the loader in its operative position.
Figure 18:
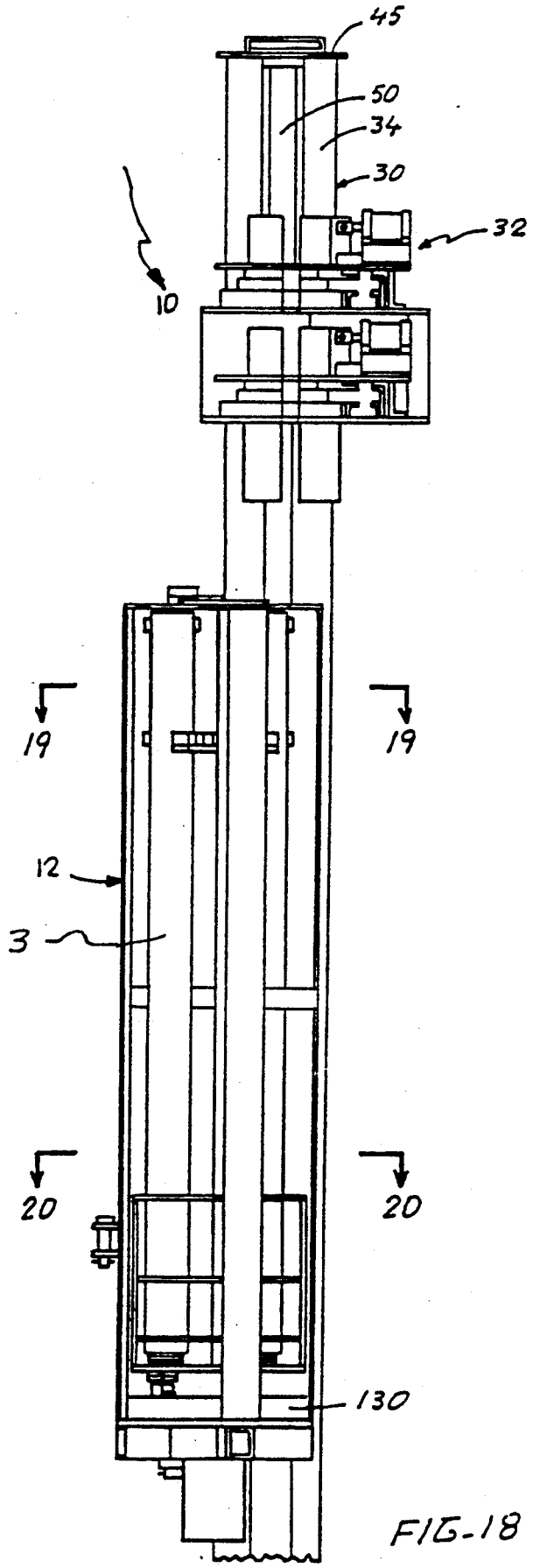
FIG. 18 is a fragmentary view of the loader and apparatus of FIG. 17 as viewed along the lines 18—18 of FIG. 17.
Figure 19:
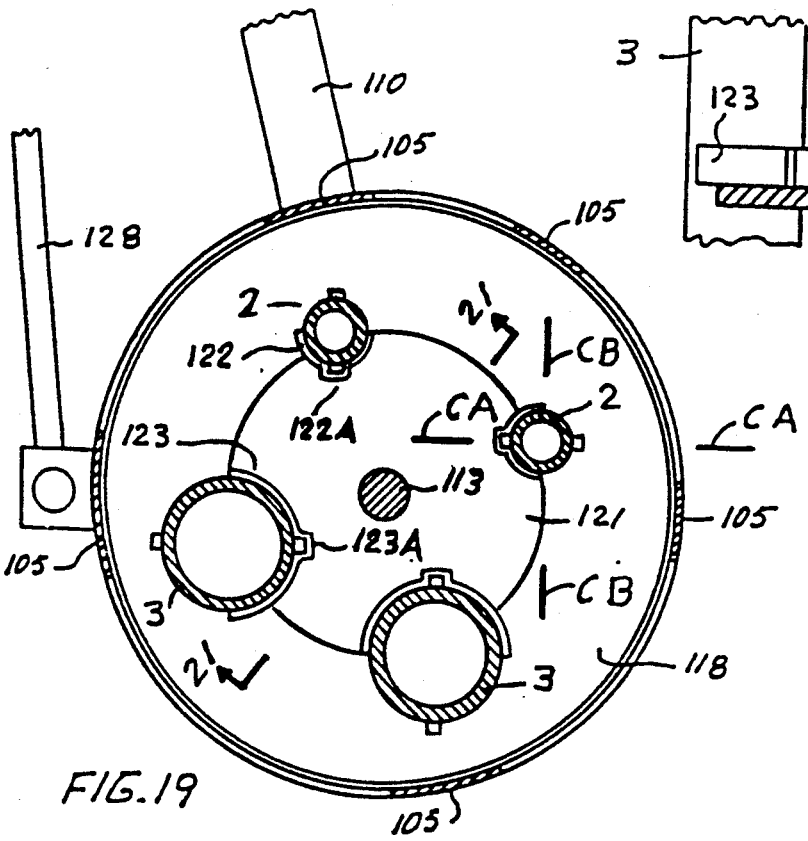
FIGS. 19 and 20 are sections taken, respectively, along the indicated lines 19—19 and 20—20 of FIG. 18.
Figure 21:
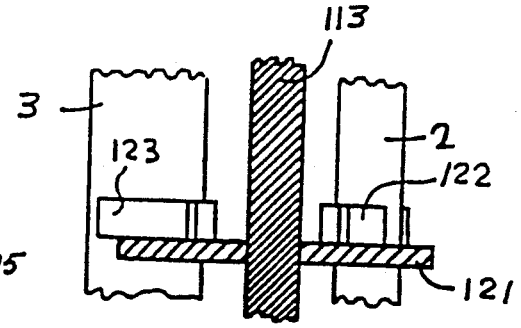
FIG. 21 is a fragmentary section taken along the indicated line 21—21 of FIG. 19.
Figure 20:
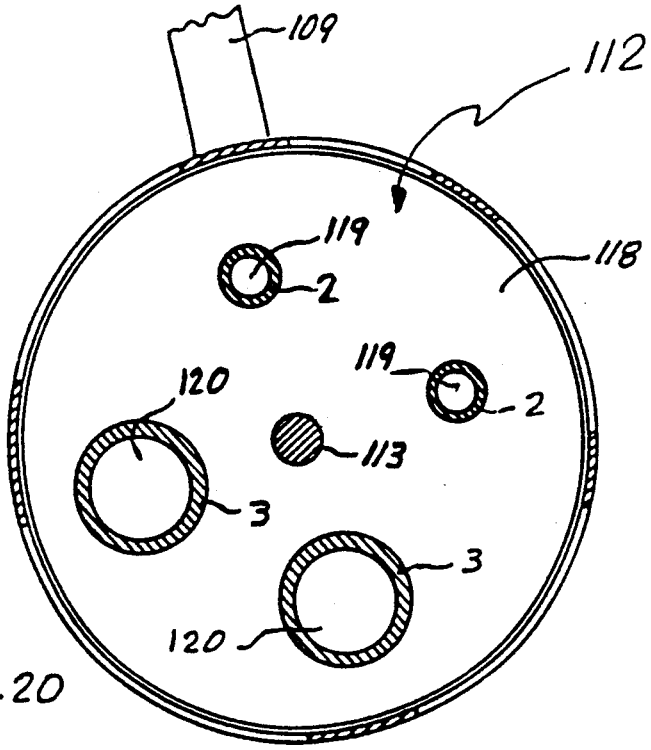

The top plate 106 has ports 124 and 125 which see FIGS. 3 and 17, open opening through its periphery between uprights 105 with the port 124 for use in placing elements in the loader 12 and the port 125 for use in withdrawing the elements which are to be driven or returning withdrawn elements to the loader. The ports 124 and 125 are dimensioned to freely receive the portions of the jaws 179A and 180A which extend below the driving unit 32. The port 125 is shaped and dimensioned to engage the jaw portions 179, see FIG. 22, to ensure that the element to be withdrawn is in the driving and withdrawing axis of the apparatus.

With the driving unit 32 raised out of the path of the loader 12, the loader is swung between its inoperative position into and out of its operative position by means of a piston-cylinder unit, see FIGS. 2 and 17, the cylinder of which is pivotally attached to the rearwardly extending arm 127 of the column 30 and the piston of which is pivotally connected to links 128 and 129, the former pivotally connected to one of the mounts 111 and the longer link 128 pivotally attached to a vertical reenforcement 105 and operable to swing and turn the loader into and out of its operative position.

With the loader in its operative position, the port 125 is in the path of the unit 32. If necessary, the rotary holder 112 is turned to bring the element which is to be transferred to the driving unit into the drilling axis or to place the socket of the holder 112 into which a withdrawn element is to be seated in that axis. It will be noted from FIG. 19 that the seats 122, 123 and their vertical channels are so formed and arranged that each when thus positioned presents its vertical channel in vertical alignment with the proximate lug of the lower pair thereof of the element being transferred to or from the driving unit 32 and is, accordingly, accurately oriented to be clamped by the appropriate jaws 179A and 180A and 279A and 280A of the clamping means during subsequent uses in accordance with the invention including the holding assembly 11 when one is used.

With the loader and a selected element thus positioned, see FIG. 22, the driving unit is lowered until the portions of the open jaws 79A and 80A which extend below the unit 32 are entrant of the port 125. The stop 106A on the cover plate 106 limits the downward travel of the driving unit 32 with the fixed jaws 179A and moveable 180A positioned to receive between them the driving end of the selected element with its upper lugs 4 so positioned that when the moveable jaw 180A is in its clamping position, a lug 4 is held within its recess 185A and the other lug 4 in the vertical channel 181A.

When the element to be transferred from the loader 12 to the driving unit 32 is a casing 3, the extent to which the lower portions of the jaws 279A and 280A can enter the loader through the port 125 is limited by the engagement of the driving end of the selected casing 3 with the fixed jaw 279A, the other lug 5 then held for entry into the recess 91 of the moveable jaw 280A when in its clamping position.

When either a drilling element or a casing is thus held, it can be removed by lifting it free of its socket to enable the loader 12 to be returned to its inoperative position. The unit, in the case of a drilling element 1 or 2, is then lowered.

From the foregoing, the use of the apparatus, the loader and the holding assembly is fully set forth as to driving operations. As the operation of those components of the invention is essentially the reverse procedure, already at least partly described, it will not be detailed.

I claim:

1. Apparatus for use in driving and withdrawing such earth entering elements as drilling and casing elements which can be threaded together end to end, each element having first and second ends, each first end the driving end and the second end, the driven end thereof, the driving end of each element provided with first and second pairs of lugs spaced lengthwise of the element with the first lugs adjacent said driving end, the lugs of each lug pair diametrically opposite and the corresponding lugs of said pairs of lugs vertically aligned, said apparatus including a column having first and second ends, means to support the column in any desired angular position of use with the second column end close to the earth, a driving and withdrawing unit, means connecting the unit to the column for movement along a predetermined path lengthwise of the support and between the ends thereof, said path establishing the axis along which elements are to be driven or withdrawn, said unit including first and second assemblies spaced apart lengthwise of the unit, the first assembly spaced a greater distance from the second end of the column than the second assembly, each assembly including a fixed jaw and a moveable jaw with said axis between them and shaped and dimensioned for clamping engagement with an element positioned between them in said axis, the moveable jaw of each assembly having an open ended, transverse channel and a recess centrally thereof shaped and dimensioned to receive a lug, each fixed jaw having an open ended transverse channel in a plane inclusive of the transverse channel of the associated moveable jaw and a lengthwise, central channel intersecting said transverse channel, the lengthwise channels in alignment, the lengthwise channel of the fixed jaw of the second assembly open ended and the lengthwise channel of the fixed jaw of the first assembly opening towards the second assembly and closed at the intersection thereof with the associated transverse channel thus to provide a stop, the recesses and lengthwise channels of the two assemblies in alignment, all of said lengthwise and transverse channels dimensioned for the slidable reception of a lug, the distance between the transverse channels of the jaws of the two assemblies equal to the distance between the two pairs of lugs of the element, each assembly provided with means operable to move the moveable jaw thereof between open and closed positions whereby, when the moveable jaws of both assemblies are in their open positions and an element is placed in said axis with its driving end proximate to the second assembly with a corresponding lug of each pair of lugs in alignment with said lengthwise channels, relative movement between the unit and the thus positioned element towards one another, causes said corresponding lugs to enter the appropriate lengthwise slot until that one of the corresponding lugs which is one of the first pair of lugs engages said stop, the lugs then positioned for entry into the appropriate ones of the transverse channels and the other corresponding lugs of the element positioned to enter the appropriate one of the recesses of the moveable jaws when in their closed positions, and each assembly also includes means to effect the turning of the pair of jaws thereof about said axis in either direction between two positions spaced 180° apart whereby first one assembly and then the other assembly may be employed to grip, impart a half turn to and then release the element with the other assembly then readied also to grip, turn and then release said element.

2. The apparatus of claim 1 and a loader operable to place an element in the axis along which elements are driven or withdrawn with the lugs of the element in a lengthwise plane inclusive of the lug receiving recesses and lengthwise channels of the moveable and fixed jaws.

3. The apparatus of claim 2 in which the loader is connected to the column to swing relative thereto between inoperative and operative positions and includes top and bottom circular plates, a series of arcuately spaced members interconnect the plates, an axial post is rotatably supported by the plates, a circular series of upwardly opening sockets is spaced about and connected to the post adjacent the bottom plate, each socket for the second or driven end of an element, and a series of arcuate seats are fixed to the post a predetermined distance below the top plate, one seat for each socket and in vertical alignment therewith and provided with a lug receiving recess, and the top plate has at least one port overlying the sockets, one after another, as the post is turned, the port also opening through the periphery of the top plate between two of the arcuately spaced members, in said operative position, the port is included in said axis, whereby a selected element held in a socket positioned in said axis may be gripped by the unit through the port and lifted from the socket and withdrawn from the loader between said two arcuate spaced members as it returns towards said inoperative position or the loader, when brought into its operative position, can receive an element through the port when held by the unit with the driven end thereof above a selected empty socket and placed therein on travel of the unit towards the second end of the column with the unit then released from the element, in either case, the lug receiving seat above the selected socket is in vertical alignment corresponding with lugs of the two pairs thereof of the element being transferred.

4. The apparatus of claim 3 in which the jaws of the second assembly include fixed and moveable portions extending below the unit, and have at least one transverse section, both the fixed and moveable portions of the section have open ended transversely aligned, lengthwise channels and open ended transverse, lug receiving channels intersected by the lengthwise channels, the channels shaped and dimensioned to accommodate the first pair of lugs of the element, the lengthwise channels in alignment with the lengthwise channels of the first and second pair of jaws, the cross sectional area of the portions extending below the unit such as to permit the entry thereof through the opening in the top plate, and means to limit the downward travel of the unit to ensure the transverse alignment of the lug receiving channels of the fixed and moveable portions with the seat also in lengthwise alignment therewith.

5. The apparatus of claim 4 in which the sockets are of two sizes, one size for drilling elements and the other size for casing elements and the fixed and moveable portions of the jaws of the second assembly also having a second transverse section between which and the second assembly said first named section is located, the fixed and moveable portions in the second section are shaped and dimensioned for clamping engagement with the driving end of a casing when the moveable portion is in the clamping position thereof, the fixed and moveable portions in the second section have lengthwise, transversely aligned channels opening only through the free end of said portions thus to provide stops and the fixed portion has an open ended transverse channel spaced from the stop a distance such as to accommodate a lug of the first pair adjacent the driving end of a casing when the driving end of a casing engages the stop of the fixed portion and the moveable portion has a lug receiving recess transversely aligned with the transverse channel of the fixed jaw in the second section thereof.

6. The apparatus of claim 5 in which the first port is shaped and dimensioned to engage the moveable portion and position a selected socket or a selected element seated therein in the axis along which elements are to be driven or withdrawn.

7. The apparatus of claim 4 in which the top plate has a second port arcuately spaced from the first port and opening through the periphery of the top plate between two of the arcuately spaced members and is dimensioned to enable any of said elements to be entered into the loader and placed in an empty socket with a lug of the second pair thereof positioned in the lug receiving socket of the exposed arcuate seat.

8. The apparatus of claim 4 in which each seat of the loader includes a brace plate attached to the post to hold any lug entrant thereof in a predetermined position relative to the lug receiving recess of the appropriate one of the first and second sections of the second assembly.

9. The apparatus of claim 1 and means operable to hold against turning the driven end of an element which has been driven into the ground and has the driven end thereof exposed a predetermined distance above the ground, the element has flattened areas parallel to and below the second pair of lugs, the holding means is a table assembly including a pair of table sections positioned a predetermined distance above the ground and interconnected in a manner providing a gap, the holding means positioned with the gap in the driving and withdrawing axis established by the unit, each table section provided with a slideway, the slideways in alignment with each other and said axis, and a slide having first and second ends and of sufficient length to span the gap with each end held by the appropriate one of the slideways, the slide having a slot opening through the first end thereof, said slide having first and second positions in the first of which the slide is held by one slideway, and in the second position, the first is held by the other slideway and the second end is held by said one slideway, with the flattened areas in the slot, the slot of the slideway of the width of an element between the flattened areas whereof thereby, with the flattened areas of the element in the end to hold the element against turning.

10. The apparatus of claim 9 in which each table section is provided with supporting legs, said sections pivotally connected to opposite sides of the column to be swung from inoperative positions towards each other into an operative position in which the gap is established and with the slideways in alignment, and means detachably connecting the sections when in the operative positions thereof.

11. An earth entering element such as a drilling or casing element having first and second ends, the first end the driving end and the second end, the driven end, the elements of a type which can be detachably connected together end to end, the driving end provided with two vertically spaced and diametrically opposed pairs of lugs and the corresponding lugs of the two pairs in alignment.

12. Apparatus for use in driving and withdrawing such earth entering elements as a drill component or a casing, the elements of the type which can be threaded together in an end to end relationship or disconnected from each other, each element having first and second ends, the first end the driving end and the second end the driven end, said apparatus including a column, means to support the column in a selected angular relationship to the earth, a driving unit, means connecting the unit to the column for movement along a predetermined path lengthwise thereof either towards or away from the earth, said path establishing the axis along which any such an element is to be driven or can be withdrawn, said unit including clamping means operable to grip or release the driving end of one of said elements when placed in said axis and to rotate the element, means to cause such rotation to be in either one of two directions of which one is a threading direction and the other is a disconnecting direction, and a loader having top and bottom ends for a plurality of elements positioned parallel to said axis and with the driving ends thereof adjacent said top end, means connecting the loader to the column and operable to swing the loader, when the unit is positioned above the path of the loader, from an inoperative position into and out of an operative transfer position in which a selected element in the loader or a selected position for an element in the loader is held in said axis whereby by lowering the unit the driving end of the selected element can be engaged and gripped by the clamping means and withdrawn from the loader by raising the unit to an extent permitting the loader to be returned to its inoperative position and the unit then lowered and the selected driven into the earth or coupled to the first end of a previously driven element or with a withdrawn element held by the unit out of the path of the loader and with the loader holding a selected position in said axis, the unit may be lowered to place the withdrawn element in said position and the clamping means operated to release the element and the unit then raised to an extent enabling the loader to be returned to the inoperative position thereof.

13. The apparatus of claim 12 in which the loader includes top and bottom plates, a series of arcuately spaced members interconnecting the plates, a central post rotatably supported by the plates, a circular series of upwardly opening sockets spaced about the post and connected thereto adjacent the bottom plate for rotation therewith, the sockets for the driven ends of elements and holding the elements seated therein parallel to the post, and the top plate is provided with at least one port above the sockets as the post is rotated, the port opening through the periphery of the top plate between two of the arcuately spaced members, said port dimensioned to receive the clamping means.

14. The apparatus of claim 13 in which the top plate has a second port arcuately spaced from said one port and opening through the periphery of the top plate between two of the arcuately spaced members and dimensioned to receive replacement elements to be placed in empty sockets.

15. The apparatus of claim 14 in which the one port is shaped and dimensioned to engage the clamping means when the clamping means is in a predetermined position lengthwise of said axis then to hold a socket in said axis.

16. A loader for use with elements such as drilling or casing elements in transferring any such element to or from apparatus having means operable to drive or withdraw an element along a predetermined axis, gripping the driving end thereof said elements having driving and driven ends, said apparatus having clamping means operable to grip and release the driving ends of the elements, the loader includes top and bottom plates, a series of arcuately spaced members connecting the plates, a post rotatably supported by the plates, and a circular series of sockets opening towards the top plate and spaced about the post and connected thereto adjacent the bottom plate, the sockets for the reception of the driven end of the elements and operable to hold received elements parallel to the post, a circular series of arcuate braces connected to the post adjacent the top plate, one brace above each socket, the top plate having at least one port opening through the periphery thereof between two of the members connecting the plates and located above the sockets as the post is turned, the loader connectable to the apparatus in a manner to enable the loader to be swung into and out of a position in which the port is in said predetermined axis.

17. The loader of claim 16 in which the elements have two vertically spaced pairs of lugs adjacent the driving ends thereof with corresponding lugs of the two pairs in lengthwise alignment, and each arcuate brace has a recess for a lug of the lower pair of lugs of an element.

18. The loader of claim 17 and the top plate has an additional port arcuately spaced from said one port and opening through the periphery thereof and for use in placing replacement elements in empty sockets and the sockets and seats arranged in two groups, one group for drilling elements and the other group for casings.

19. The loader of claim 17 in which the elements have first and second vertically spaced pairs of lugs adjacent the driving end therefor, corresponding lugs of the two pairs vertically aligned and the arcuate braces have central lug receiving seats, each accommodative of a lug of the pair of lugs spaced from the driving end of an element by one of the other pair of lugs.

* * * * *